US009725859B1

(12) United States Patent
Hernandez

(10) Patent No.: US 9,725,859 B1
(45) Date of Patent: Aug. 8, 2017

(54) PICK-UP HEAD FOR STREET SWEEPING AND CLEANING VEHICLES

(71) Applicant: Armando Hernandez, Las Vegas, NV (US)

(72) Inventor: Armando Hernandez, Las Vegas, NV (US)

( * ) Notice: Subject to any disclaimer, the term of this patent is extended or adjusted under 35 U.S.C. 154(b) by 27 days.

(21) Appl. No.: 15/049,581

(22) Filed: Feb. 22, 2016

(51) Int. Cl.
*E01H 1/08* (2006.01)

(52) U.S. Cl.
CPC ..... *E01H 1/0872* (2013.01)

(58) Field of Classification Search
CPC . A47L 5/14; A47L 9/08; E01H 1/0863; E01H 1/0854; E01H 1/0845
See application file for complete search history.

(56) References Cited

U.S. PATENT DOCUMENTS 3,512,206 A * 5/1970 Young ..... E01H 1/0863 15/340.1
3,872,540 A * 3/1975 Block ..... A47L 5/14 15/340.1
4,359,801 A * 11/1982 Tate ..... E01H 1/0863 15/346
4,466,156 A * 8/1984 Blehert ..... E01H 1/0863 15/346
4,807,327 A * 2/1989 Jajko ..... E01H 1/0863 15/346
5,542,148 A * 8/1996 Young ..... E01H 1/0872 15/340.3
5,852,847 A * 12/1998 Weiss ..... E01H 1/0863 15/340.1
2005/0217064 A1* 10/2005 Libhart ..... E01H 1/0863 15/340.1
2008/0083084 A1* 4/2008 Schwarze ..... E01H 1/0863 15/346

* cited by examiner

*Primary Examiner* — Dung Van Nguyen
(74) *Attorney, Agent, or Firm* — FisherBroyles LLP; Rob L. Phillips

(57) ABSTRACT

A pick-up head for a street sweeper having easy-to-change curtains. The pick-up head having a body; an air pressure chamber defined by the body, the air pressure chamber including an air blower chamber and air suction chamber, and corresponding air blower orifice and air suction orifice in the body; an elongated opening in the body for receipt of at least one curtain, the at least one curtain made of a durable material, the at least one curtain having an upper spine configured to reside in the elongated opening; and a pair of guide rails extending above and along opposite edges of the elongated opening, the guide rails configured to slidably receive a retention member positioned to retain the at least one curtain within the elongated opening. An expansion chamber and slotted shoe plate further enhances the operation of the pick-up head.

14 Claims, 9 Drawing Sheets

PICK-UP HEAD FOR STREET SWEEPING AND CLEANING VEHICLES

FIELD OF THE INVENTION

The embodiments of the present invention relate to a pick-up head with an easy-to-change skirts or curtains.

BACKGROUND

Conventional heads for street cleaning vehicles receive skirts or curtains with many fasteners such that changing the skirts or curtains is very labor intensive and time consuming. Indeed, changing a conventional skirt may take up to 8 hours. During the changing process, the street sweeper is out of commission to the detriment of its owner.

Accordingly, it would be beneficial to develop a pick-up head for receiving and securing a skirt in an easy-to-change configuration.

SUMMARY

Accordingly, one embodiment of the pick-up head comprises a body; an air pressure chamber defined by said body, said air pressure chamber including an air blower chamber and air suction chamber, and corresponding air blower orifice and air suction orifice in said body; an elongated opening in said body for receipt of at least one curtain, said at least one curtain made of a durable material, said at least one curtain having an upper spine configured to reside in said elongated opening; and a pair of guide rails extending above and along opposite edges of said elongated opening, said guide rails configured to slidably receive a retention member positioned to retain said at least one curtain within said elongated opening.

In practice, changing the curtain requires slidably removing said retention member and removing said curtain out of the elongated opening by grabbing and lifting the curtain by said upper spine.

Other embodiments of the pick-up head include an expansion chamber and/or slotted shoe plate to further enhance the operation of the disclosed pick-up head.

Other variations, embodiments and features of the present invention will become evident from the following detailed description, drawings and claims.

DETAILED DESCRIPTION

Figure 1A:
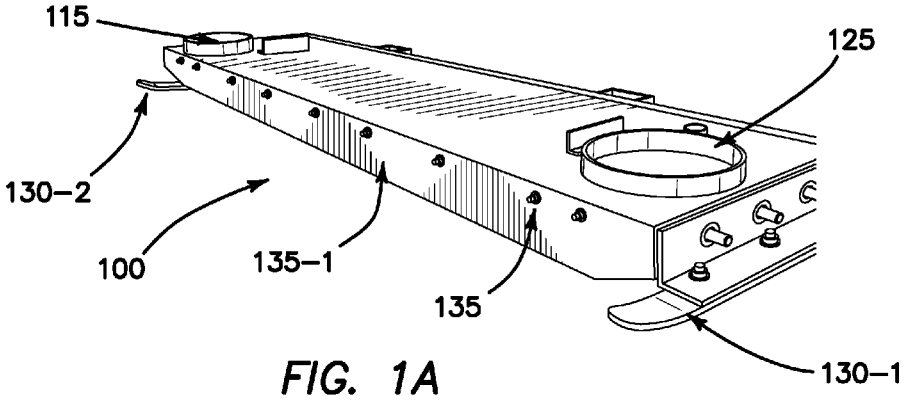
FIGS. 1A and 1B illustrate a conventional pick-up head of the type used with a street sweeper.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the embodiments of the present invention may be fabricated of any suitable materials, including, but not limited to, plastics, alloys, composites, resins and metals, and may be fabricated using suitable techniques, including, but not limited to, molding, casting, machining and rapid prototyping.

Street sweeper curtains serve to maintain and direct dust and debris from existing areas proximate to the street sweeper pick-up head and may drag across concrete and asphalt. Accordingly, the curtains (aka skirts and flaps) are made of durable materials such as high durometer level rubber with little elasticity and resistance to indentations. Rubber-Cal of Santa Ana, Calif. manufacturers such curtains. The curtains may be manufactured of other materials such as polymers and the like as long as the curtains perform. A pick-up head may have a front and rear curtain relative to the direction of travel.

Figure 1B:
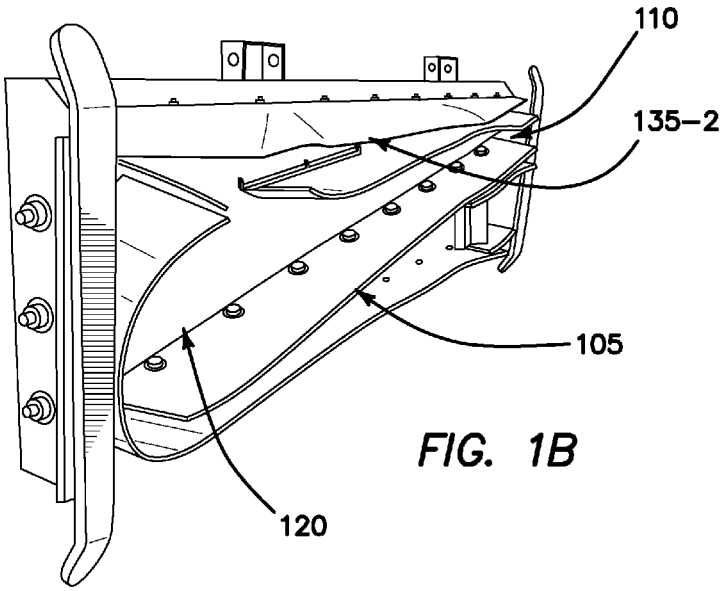

FIGS. 1A and 1B show a conventional pick-up head 100 comprising an air pressure chamber 105, an air suction chamber 110, suction orifice 115, blast chamber 120 and blast orifice 125 and shoes 130-1 and 130-2. Curtains 135-1 and 135-2 are shown attached to the pick-up head 100 using a series of nuts and bolts 140.

Figure 2:
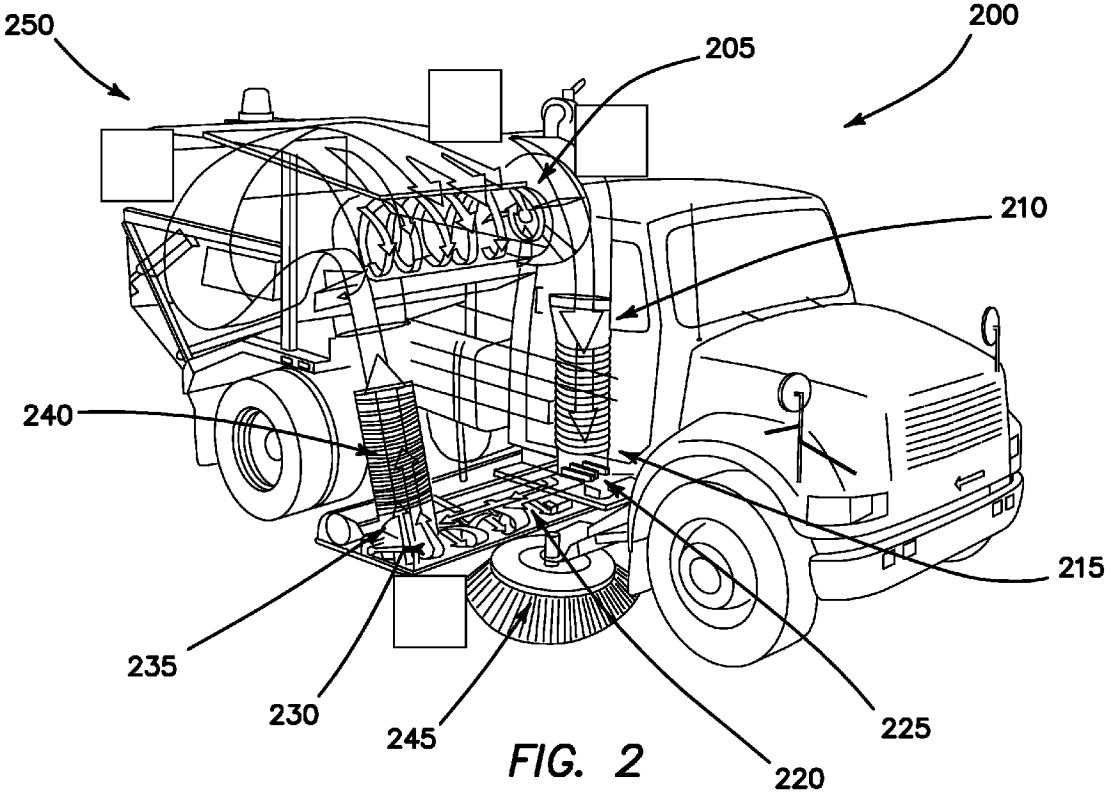
FIG. 2 illustrates a street sweeper of the type suitable to utilize the pick-up head according to the embodiments of the present invention.

FIG. 2 shows a street sweeper 200 comprising a blower wheel 205, blower tube 210, blast orifice 215, air pressure chamber 220, blast chamber 225, air suction chamber 230, suction orifice 235, suction tube 240, brush 245 and hopper 250.

Figure 3A:
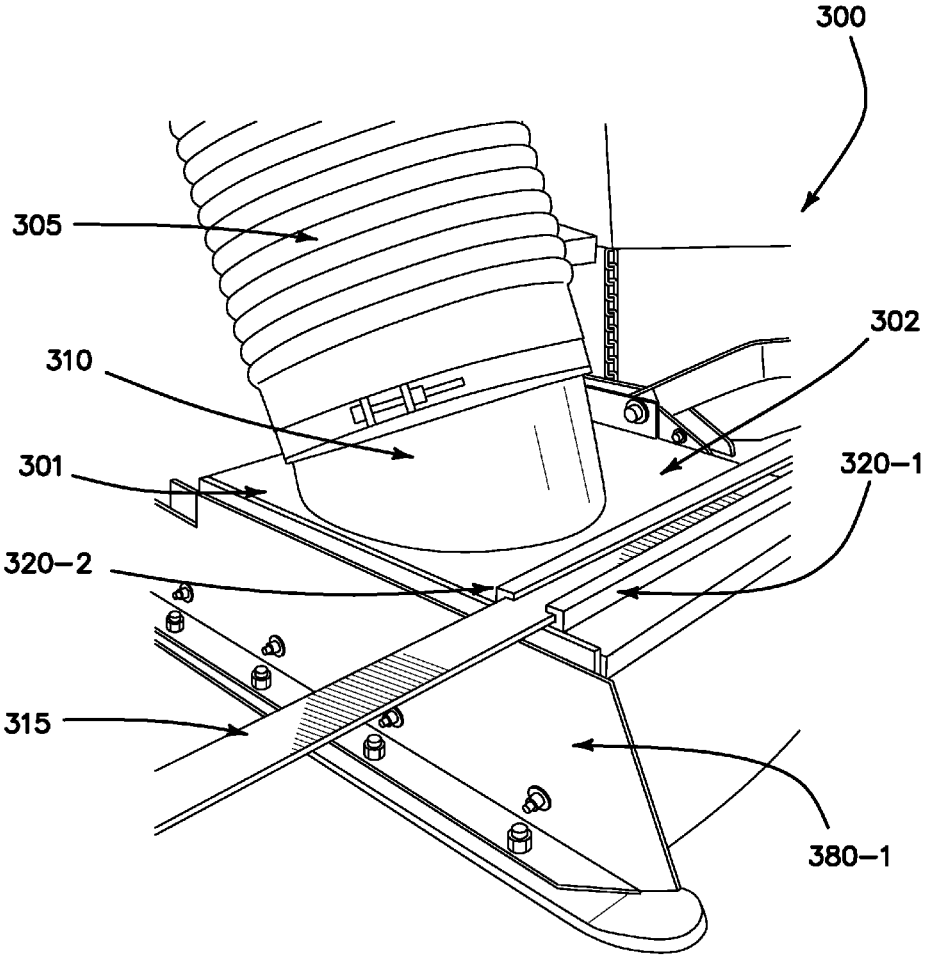
FIGS. 3A-3F illustrate views of a pick-up head according to according to the embodiments of the present invention.
Figure 3B:
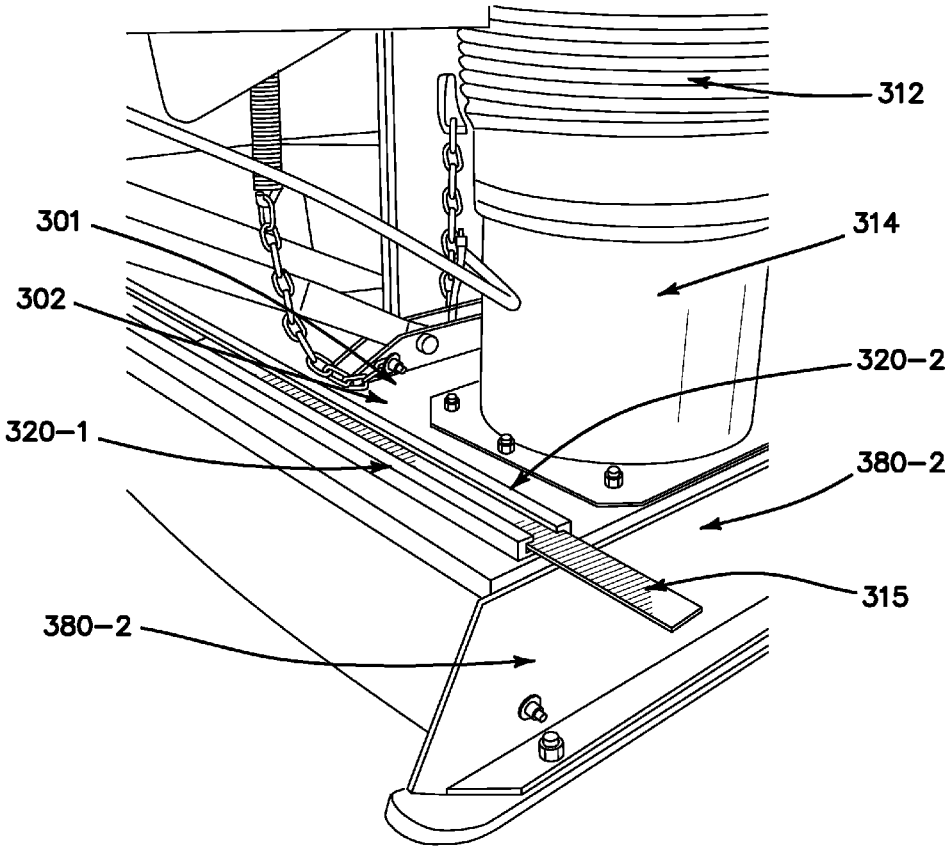

FIGS. 3A and 3B show a pick-up head 300 according to the embodiments of the present invention. FIG. 3A shows a blower tube 305 extending into a blast orifice collar 310 secured to an upper surface 302 of said pick-up head 300 while FIG. 3B shows a suction tube 312 extending into a suction orifice collar 314 secured to an upper surface 302 of said pick-up head 300. A retention member 315 is shown being removed from a pair of guide rails 320-1 and 320-2 each defining a slot 322-1 and 322-2 (best shown in FIGS. 4A-4C). The guide rails 320-1 and 320-2 are above, and adjacent to oppositely spaced edges of, elongated opening 323 (best shown in FIGS. 4A-4C) in a pick-up head body 301. The guide rails 320-1 and 320-2 define a slotted channel above the elongated opening 323. The elongated opening 323 extends across a width of the pick-up head body 301. While shown as separate elements from the upper surface 302 of the pick-up head body 301, it is understood that the guide rails 320-1 and 320-2 may be integral with the pick-up head body 301. The retention member 315, as shown, is a rigid, flat bar serving to (i) maintain the curtain 375 in position within the elongated opening 323 when slidably inserted into the slotted channel defined by the guide rails 320-1 and 320-2 and (ii) permit removal of the curtain 375 when slidably removed from the guide rails 320-1 and 320-2. Elevating the guide rails 320-1 and 320-2 above the elongated opening 323, allows the retention member 315 and curtain 375 to be removed without having to remove the shoes 380 as is necessary with many conventional pick-up heads.

Figure 3C:
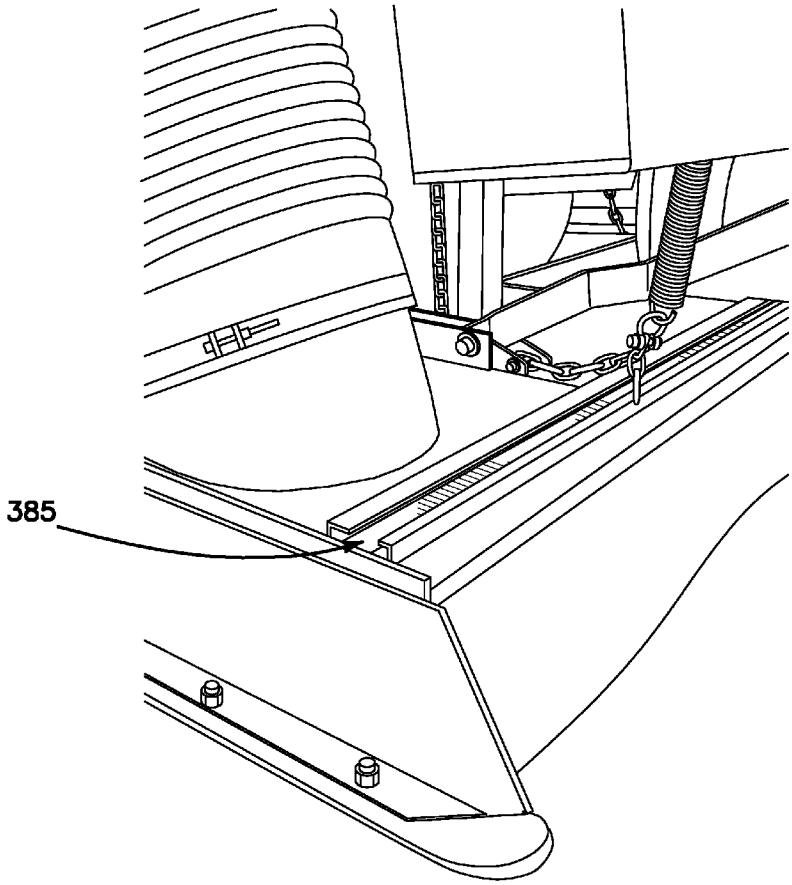
Figure 3D:
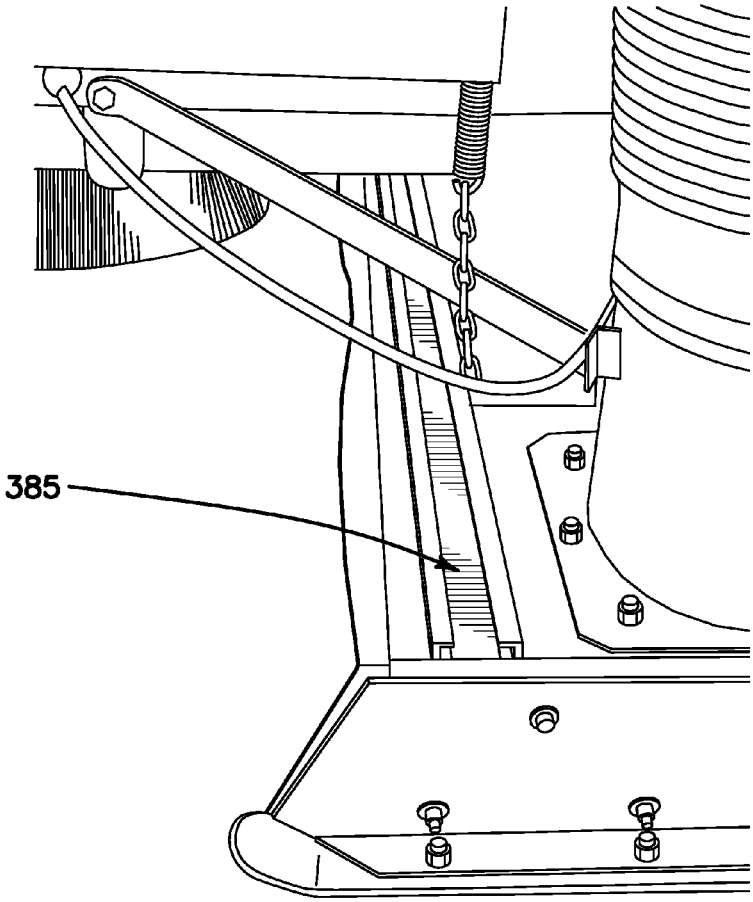
Figure 3E:
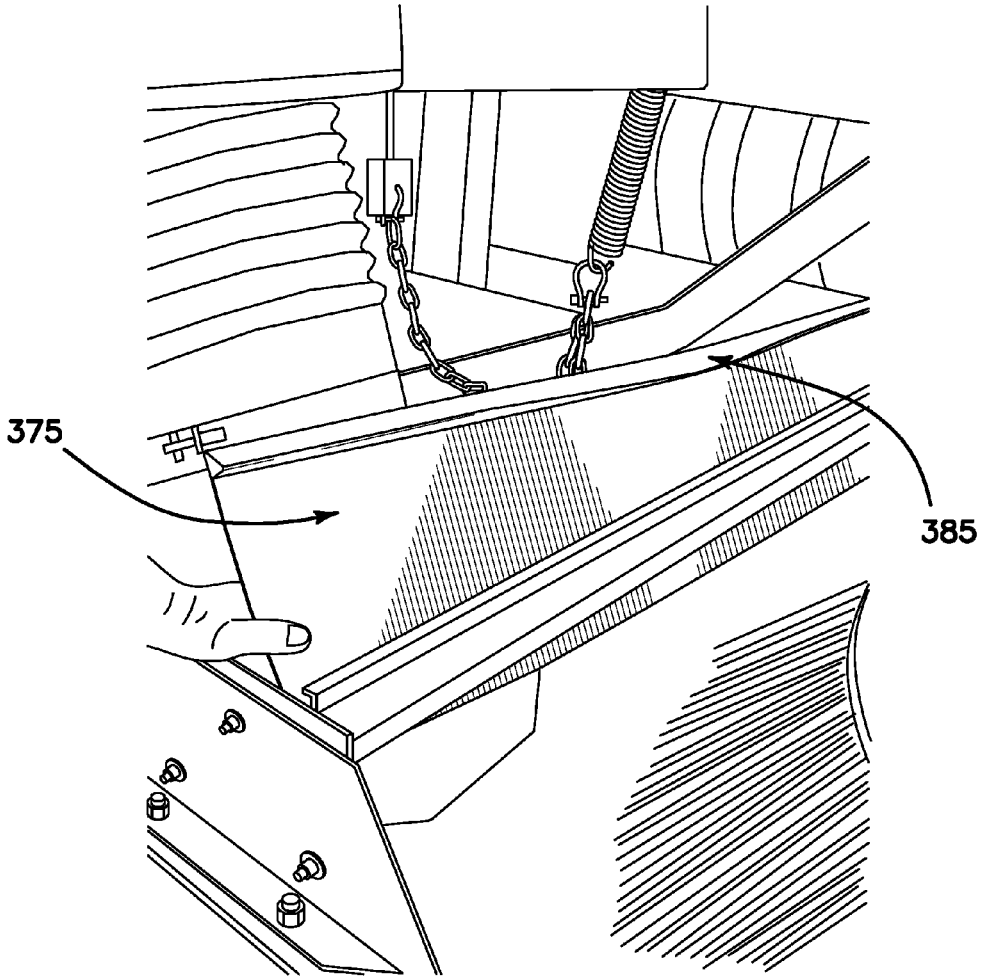
Figure 3F:
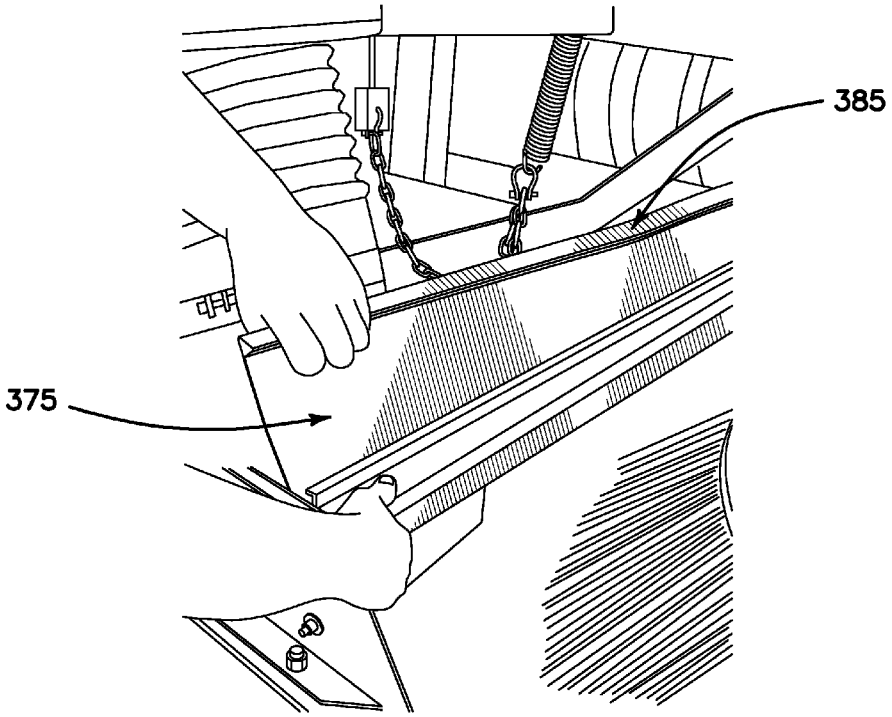

FIGS. 3C and 3D show the pick-up head 300 with the retention member 315 removed from the guide rails 320-1 and 320-2. With the retention member 315 removed from the slots 322-1 and 322-2, the upper spine 385 of the curtain 375 is visible within the elongated opening 323. The upper spine 385 maintains the curtain 375 within the elongated opening 323 and acts as a point-of-grasp for lifting and lowering the curtain 375 from and into the elongated opening 323 as shown in FIGS. 3E and 3F. FIGS. 3E and 3F show the curtain 375 being lifted from elongated opening 323 by grasping the upper spine 385. In one embodiment, the upper spine 385 is manufactured of durable rubber or other suitable materials.

Figure 4A:
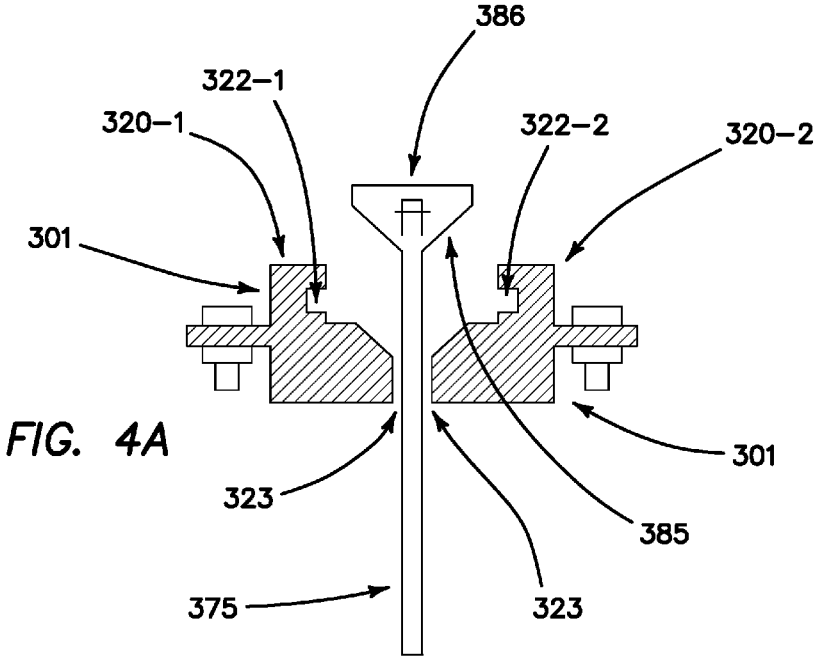
FIGS. 4A and 4B illustrate cross-sectional views of said pick-up head according to the embodiments of the present invention.
Figure 4B:
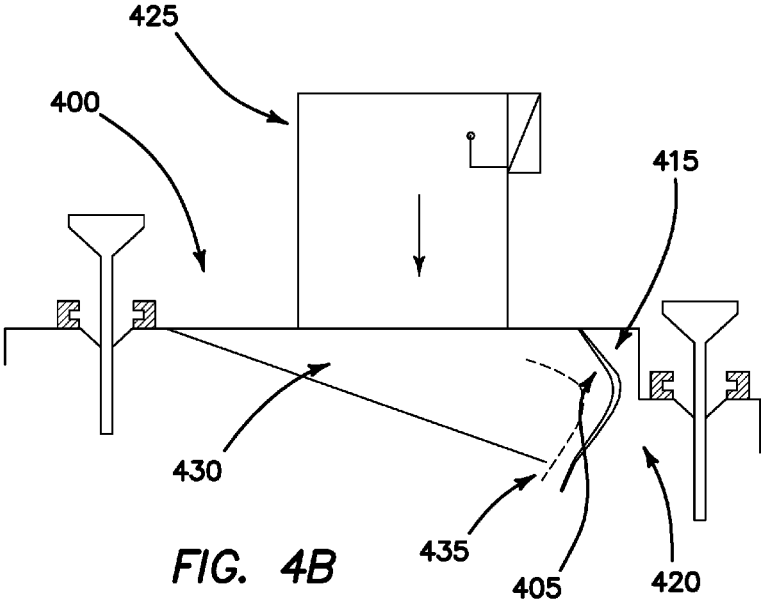

FIGS. 4A-4C show cross-sectional views of said pick-up head 300 according to the embodiments of the present invention. FIG. 4A shows a cross-sectional view of pick-up head body 301 and curtain 375. In one embodiment, the elongated opening 323 is V-shaped to receive the V-shaped upper spine 385 of curtain 375. The elongated opening 323 and upper spine 385 are dimensioned such that an upper surface 386 of the upper spine 385 is positioned below slots 322-1 and 322-2 of elongated opening 323. In this manner, the flat bar retention member 315 may slide into and out of the slots 322-1 and 322-2 to maintain the curtain 375 in place. As set forth above, the slots 322-1 and 322-2 are higher than the shoes 130-1 and 130-2 permitting the retention member 315 to be removed and inserted without removal of the shoes 130-1 and 130-2. While a V-shaped correspondence is shown between the upper spine 385 and elongated opening 323, those skilled in the art will recognize that other cross-sectional shapes are suitable as well.

FIG. 4B shows a pick-up head 400 having a pressure expansion chamber 405 created by deflector 415 which extends downward from said pick-up head 400. The deflector 415 is near the front of the pick-up head 400 and extends along a width thereof. The deflector 415 is bowed outward toward a front 420 of the pick-up head 400 such that high pressure air (represented by arrows) generated by a blower (not shown) through blower tube 425 is more uniformly distributed into an air chamber 430 defined by the pick-up head body 410. A vertical front wall tends to create turbulence as the high pressure air enters a conventional pick-up head whereas the bowed deflector 415 serves to better direct the through an opening 435 associated with the air chamber 430.

Figure 5:
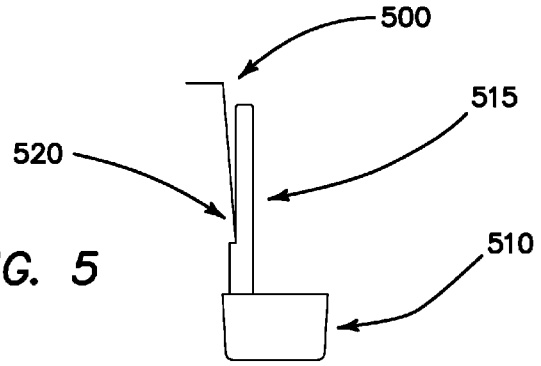
FIG. 5 illustrates a side view of a slotted shoe plate according to the embodiments of the present invention.

FIG. 5 shows a side view of a slotted shoe plate according to the embodiments of the present invention. Pick-up head 500 supports shoes 510. Arm 515 is connected to the pick-up head 500 via slotted plate 520. In this arrangement, the position of the shoes 510 may be changed easily and the slotted plate 520 maintains a consistent space between the shoes 510 and ground over which the vehicle is traversing.

Although the invention has been described in detail with reference to several embodiments, additional variations and modifications exist within the scope and spirit of the invention as described and defined in the following claims.

I claim:

1. A pick-up head comprising:

a body;

an air pressure chamber defined by said body, said air pressure chamber including an air blower chamber and air suction chamber, and corresponding air blower orifice and air suction orifice in said body;

an elongated opening in said body for receipt of at least one curtain, said at least one curtain made of a durable material, said at least one curtain having an upper spine configured to reside in said elongated opening; and a pair of guide rails extending above and along opposite edges of said elongated opening, said guide rails configured to slidably receive a retention member positioned to retain said at least one curtain within said elongated opening.

2. The pick-up head of claim 1 further comprising shoes on each end of said body.

3. The pick-up head of claim 2 wherein said pair of guide rails is positioned higher than said shoes.

4. The pick-up head of claim 1 wherein said elongated opening and upper spine have corresponding V-shaped cross-sections.

5. The pick-up head of claim 1 wherein said guide rails define opposite-facing, spaced slots.

6. The pick-up head of claim 5 wherein a flat bar retention member is configured to slidably insert into said opposite-facing, spaced slots.

7. The pick-up head of claim 1 further comprising a bowed deflector near a front of said pick-up head and extending along a width thereof.

8. A pick-up head comprising:

a body;

an air pressure chamber defined by said body, said air pressure chamber including an air blower chamber and air suction chamber, and corresponding air blower orifice and air suction orifice in said body;

an elongated opening in said body for receipt of at least one curtain, said at least one curtain made of a durable material; and a bowed deflector near a front of said pick-up head and extending along a width thereof.

9. The pick-up head of claim 8 further comprising shoes on each end of said body.

10. The pick-up head of claim 8 further comprising a pair of guide rails extending above and along opposite edges of said elongated opening, said guide rails defining opposite-facing, spaced slots.

11. The pick-up head of claim 8 further comprising an upper spine extending a length of one edge of said at least one curtain.

12. The pick-up head of claim 11 wherein said elongated opening and upper spine have corresponding V-shaped cross-sections.

13. The pick-up head of claim 10 further comprising a flat bar retention member configured to slidably insert into said opposite-facing, spaced slots.

14. A pick-up head comprising:

a body;

an air pressure chamber defined by said body, said air pressure chamber including an air blower chamber and air suction chamber, and corresponding air blower orifice and air suction orifice in said body;

an elongated V-shaped center channel in said body for receipt of at least one curtain, said at least one curtain made of a durable material, said at least one curtain having an upper V-shaped spine configured to reside in said elongated V-shaped center channel; and a slotted channel above said elongated V-shaped channel, said slotted channel configured to slidably receive a retention member positioned to retain said at least one curtain within said elongated V-shaped channel.

* * * * *